United States Patent [19]

Yaita

[11] Patent Number: 4,840,510

[45] Date of Patent: Jun. 20, 1989

[54] CONTAINER WITH BRUSH AND FLUID METERING UNIT FOR FLUID TYPE COSMETICS

[75] Inventor: Shigeru Yaita, Saitama, Japan

[73] Assignee: Kabushiki Kaisha Yaita Seisakusho, Saitama, Japan

[21] Appl. No.: 113,116

[22] Filed: Oct. 27, 1987

[30] Foreign Application Priority Data

Oct. 29, 1986 [JP] Japan ..... 61-165961[U]

[51] Int. Cl.[4] ..... A46B 11/02

[52] U.S. Cl. ..... 401/149; 401/37; 401/39; 401/146; 401/150; 401/286; 401/288

[58] Field of Search ..... 401/146, 149, 150, 288, 401/286, 37, 38, 39

[56] References Cited

U.S. PATENT DOCUMENTS

| | | | |
|---|---|---|---|
| 543,969 | 8/1895 | Santee | 401/278 |
| 1,392,369 | 10/1921 | Stoewsand | 401/150 |
| 1,615,104 | 1/1927 | Walker | 401/150 |
| 1,811,512 | 6/1931 | Marsh | 401/150 X |
| 1,889,309 | 11/1932 | Beckert | 401/150 |
| 2,072,620 | 3/1937 | Fitch | 401/288 X |
| 2,272,641 | 2/1942 | Mureau | 401/288 |
| 3,903,888 | 9/1975 | Buelow et al. | 401/150 X |

FOREIGN PATENT DOCUMENTS

| | | | |
|---|---|---|---|
| 247238 | 5/1912 | Fed. Rep. of Germany | 401/150 |

*Primary Examiner*—Steven A. Bratlie

*Attorney, Agent, or Firm*—Wenderoth, Lind & Ponack

[57] ABSTRACT

A container with a brush to be used for fluid type cosmetics, wherein the fluid type cosmetics contained with the container are supplied to the brush mounted at the tip of the container by pushing a pushing unit mounted on the periphery of the container in a direction perpendicular to the axial direction of the container.

5 Claims, 2 Drawing Sheets

CONTAINER WITH BRUSH AND FLUID METERING UNIT FOR FLUID TYPE COSMETICS

BRIEF SUMMARY OF THE INVENTION

The present invention relates to a container equipped with a brush to be used for fluid type cosmetic products such as fluid type rouge, manicure liquid, etc., wherein fluid type cosmetic products are pushed out of the container and are supplied to the brush furnished outside the container.

In a conventional container with a brush used for fluid type cosmetic products, a cap is furnished that is separate from the container. To use this product, the brush has to be inserted into the container and dipped in the fluid cosmetic product so that the latter attaches to the brush. Then, the brush has to touched to the periphery of the container opening in order to reduce or adjust the quantity of the fluid attached to the brush for proper use of the cosmetic product.

In practical use of such conventional containers with separate brushes, it is often troublesome to insert and withdraw the brush into and from the container. In such case, the container may fall down unless the brush and the container are each held separately by different hands when the brush is inserted and withdrawn, and this means much inconvenience for the users.

SUMMARY OF THE INVENTION

The purpose of the present invention is to provide a container equipped with a brush for fluid type cosmetic products, in which the above-mentioned defects are completely eliminated.

In order to attain such purpose, the container with brush based on the present invention comprises a housing unit, where the fluid type cosmetic product such as fluid type rouge, manicure liquid, etc. are contained, and an outlet, from where said fluid type cosmetic product is to be discharged, and these two units are connected with each other through a passage. Further, a brush is furnished outside said container so that the fluid type cosmetic product is supplied through the outlet. A pushing unit is provided, which can be moved forward and backward from the direction perpendicular to said passage with respect to said outlet and which is moved by a means such as a spring in the return direction. The pushing unit is pushed from outside the container and is entered into said passage, whereby the fluid type cosmetic product within said passage is pushed toward said outlet so that the brush is fed with the cosmetic product. This enables the user to push the pushing unit forward while making herself up, and the troublesome handling of the container and the brush by different hands is eliminated.

DETAILED DESCRIPTION OF THE INVENTION

Figure 1:
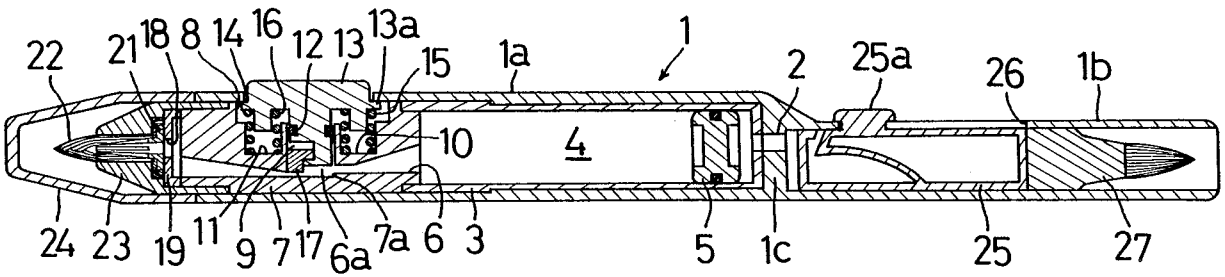
FIG. 1 is a longitudinal sectional view of the container with brush, where fluid type rouge is contained.

As shown in FIG. 1, the container 1 of approximately cylindrical shape includes a large-diameter unit 1*a* and a small-diameter unit 1*b*, which are separated from each other by a partition wall 1*c* but are connected through a through-hole 2. A part of the peripheral surface (upper portion as shown in FIG. 1) is formed somewhat flat. On the other hand, a cylinder body with one closed end 3 is inserted and fixed within said large-diameter unit 1*a* along said partition wall 1*c*, and a through-hole is furnished on this body to match with the through-hole 2. The inner space of this cylinder body is used as a housing unit or cosmetics reservoir 4. Within this housing unit or reservoir 4, a piston 5 with an O-ring (unnumbered) on its periphery is arranged so that it can slide freely within the cylinder. By means of this piston 5, the interior of said housing unit 4 is shut off from the through-hole 2, and the fluid type rouge (not shown) is contained within said housing unit thus shut off.

Figure 2:
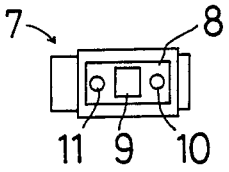
FIG. 2 is a plan of the block unit furnished with a passage.

Within the large-diameter unit 1*a*, a block unit 7 having approximately cylindrical shape is inserted and fixed along the open end of said cylinder body 3, and this body is furnished with a passage body 6, leading substantially along the axial direction toward the housing unit 4. The passage 6 is formed in such manner as to have its height (width) reduced at the center, and a step 7*a* is arranged on lower inside surface of the housing unit 4 at the reduced portion 6*a*. On the other hand, the upper inside surface of the housing unit 4 is positioned approximately at the same height as that of the step 7*a*. As is evident from FIG. 2, a rectangular concave portion 8 is provided around the counterflow passage 6 of the block unit 7, and a square-shaped through-hole 9 is arranged to provide a passage from the concave portion 8 to the reduced portion 6*a*. Round holes 10 and 11 are furnished on both sides of said concave portion 8 at the through-hole 9 and its portion lower than the seal ring 12 is approximately formed in an "L" shape. On the periphery of the large-diameter unit 1*a*, a through-hole 14 is arranged which is positioned to face the concave portion 8 and is sized smaller than that portion. Said pushing unit 13 is pushed toward the return direction from the passage 6 by resilient force of the coil springs 15 and 16 mounted in round holes 10 and 11 respectively, and its upper end is exposed through the through-hole 14. Since the projection 13*a* at both upper ends of said pushing unit 13 is stopped by the edge of said through-hole 14, the pushing unit is prevented from falling away from said large diameter unit 1*a*. On the L-shaped lower portion of said pushing unit 13, a shut-off unit 17 of approximately L-shape is mounted movably and is prevented from falling off. Said shut-off unit 17 contacts with the wall surface of said through-hole 9 with adequate friction, and its lower surface is arranged in such manner that it is at the same height as the upper surface of the step 7*a*. The clearance between the upper surface of said shut-off unit 17 and the lower center surface of the pushing unit 13 is designed to be equal to the clearance between the lower surface of the pushing unit 13 and the upper surface of the step 7*a*.

Figure 3:
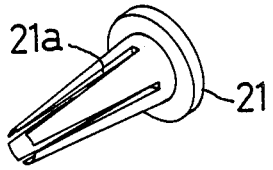
FIG. 3 is an enlarged perspective view of the guide unit.

At the end of the housing unit 4 of the block body 7, a covering 19 having U-shaped section and provided with an outlet 18 is fixed, and the base of a guide 21 is secured on this covering 19. As is clearly understood from FIG. 3 the guide 21 is approximately in the shape of a conical cylinder, and four notches 21*a* are furnished from the tip toward the base with the same spacings between them. A brush 22 is mounted on said guide 21 as if it covers the latter, and the base of the brush 22 is pressed together and fixed on the base of said guide 21. A stationary cover 23 is inserted and fixed between the large-diameter unit 1*a* and the block body 7 from the tip of the brush 22 so that only the tip of the brush protrudes from it. A cap 24 is removably mounted on this fixed cover 23.

On the other hand, a movable body 25 is longitudinally inserted into the small-diameter unit 1*b* of the container 1, and the operating unit 25*a* of the movable body 25 is protruding from the slit 26, which is formed on the flat surface of the small-diameter unit 1*b*. A brush 27 to be used for corrections of make-up is fixed at the end of the partition wall 1*c* of said movable body 25. When said operating unit 25*a* is moved along said slit 26, the brush 27 comes out of the opening of the small-diameter 1*b*.

Next, explanation will be given on the feeding of the fluid type rouge (not shown), contained in the housing unit 4 of the above-mentioned embodiment, to the brush 22.

When the pusing unit 13 is pushed against the resilient force of the coil springs 15 and 16, the lower portion of said pushing unit 13 enters into the reduced portion 6*a* of the passage 6. In this case, the shut-off unit 17 does not enter into the reduced portion 6*a* and remains at the same position as shown in FIG. 1 because an idle space exists between the upper surface of the shut-off unit and the lower center surface of said pushing unit 13 and also because friction force against the wall of the through-hole 9 and specific gravity of the fluid type rouge is considerably large. When the lower end of said pushing unit 13 moves to the position at the same height as that of the step 7*a*, no idle space is maintained any more and said shut-off unit 17 is pushed by said pushing unit 13, moving so that the lower ends of both units 14, and 17 are kept at the same level. (See FIG. 4 (*a*).) Accordingly, the fluid type rouge within the reduced portion 6*a* is stopped from moving toward the housing unit 4 and is pushed toward the outlet 18 as said pushing unit 13 and said shut-off unit 17 enter there. The same quantity of fluid type rouge as that of the rouge, pushed by the above movement, is supplied to the brush 22 through said outlet 18. In this case, the fluid type rouge is not totally supplied to the base of the brush 22 through said outlet 18, but it is gradually sent toward the tip of the brush 22 through the guide 21. Thus, steady and adequate feeding of fluid type rouge to the brush 22 is assured. The pushing operation of the fluid type rouge is completed when said pushing unit 13 and the lower end of said shut-off unit 17 reach the lower surface of said reduced portion 6*a*. (See FIG. 4 (*b*).) Thus, the supply to the brush of fluid type cosmetics does not return to the housing unit, and the cosmetic material is supplied on a steady and secure basis for supplying a constant quantity of the material.

Figure 4:
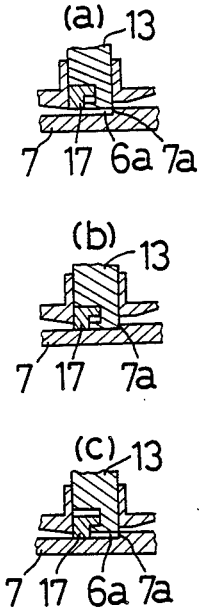
FIGS. 4 (*a*)–(*c*) are schematic sectional views to the explain the operation of the pushing unit and the shut-off unit.

When the pushing force on the pushing unit 13 is released, said pushing unit 13 retreats from the reduced portion 6*a* into the block body 7 by the force of coil spring 15 and 16. As shown in FIG. 4 (*b*), there exist an idle space between the lower surface of the upper portion of the shut-off unit 17 and the upper surface of the lower end of said pushing unit 13. Accordingly, said shut-off unit 17 does not move until no more idle space is held there. (See FIG. 4 (*c*).) As the result, negative pressure is created in the reduced portion 6*a* after said pushing unit 13 begins to retreat, and the fluid type rouge enters into said reduced portion 6*a* smoothly from the housing unit 4. Further, when the pushing unit 13 retreats, the shut-off unit 17 moves along with said pushing unit 13 and is returned to the standby status as shown in FIG. 1.

In this way, adequate quantity of fluid type rouge is supplied to the brush 22 through the outlet 18 each time the pushing unit 13 is pressed, and the pushing operation of said pushing unit 13 can be performed by the finger of the hand which is holding the container 1.

When the brush 27 is pushed out of the container 1 by operating the operating unit 25*a*, it can be used as a brush for correction of the make-up.

It should be understood that the present invention is not limited to the description on the above-mentioned embodiment and that many changes and modifications may be made by those skilled in the art without departing from the scope of the appended claims, that it is applicable to any type of cosmetic products such as rouge, manicure liquid, etc. if they are of fluid type and that the small-diameter unit 1*b* with the brush 27 is not always necessary. Furthermore, it is possible to supply the fluid type cosmetics to the brush 22 through the outlet 18 only by the forward and backward (or in and out) movement of the pushing unit 13 even when the shut-off unit 17 is not provided. Also, the passage 6 may be of any shape, if it lies between the outlet 18 and the housing unit 4 and if it can pass the fluid type cosmetic products. In other words, the passage 6 includes the portion, where the fluid type cosmetic is held between the outlet 18 and the housing unit 4.

As it is evident from the above description, the present invention offers a container to feed the fluid type cosmetic product to the brush by simple construction and easy operation, and the invention provides useful effects and convenience for the user such as the elimination of the troublesome separate handling of the container and the brush.

I claim:

1. A fluid dispenser for fluid cosmetics comprising:

a housing;

a cosmetics reservoir in said housing for containing fluid cosmetics;

a brush attached to said housing for receiving and distributing fluid cosmetics;

a fluid passage in said housing for fluidly communicating said brush and said reservoir, said fluid passage having an intermediate passage portion having first and second ends, and said fluid passage having a stepped portion; and a fluid metering means attached to said housing for metering fluid from said cosmetics reservoir through said fluid passage to said brush, said fluid metering means including a pushing unit movably received within said housing, said pushing unit having a first portion extending out of said housing and a second portion for extending into said stepped portion of said fluid passage, said second portion being substantially L-shaped, said fluid metering means further including a movable substantially L-shaped shut-off unit adjacent said second portion and freely movable in the direction for entering said fluid passage for pushing out fluid from said fluid passage toward said brush and for blocking off fluid communication between said brush and said reservoir, said fluid metering means further including a biasing means for urging said first portion of said pushing unit outwardly of said housing, said second portion blocking off fluid communication between said brush and said reservoir when said first portion of said pushing unit is moved inwardly into said fluid passage, said pushing unit then contacting said shut-off unit for moving said shut-off unit into said fluid passage while moving said second portion into said stepped portion of said passage for forcing fluid cosmetics out of said stepped portion toward said brush when said first portion of said pushing unit is moved further inwardly into said fluid passage, said second portion then further moving said shut-off unit into said fluid passage for blocking off fluid communication between said brush and said reservoir, said biasing means then moving said second portion in a return direction out of said stepped portion of said fluid passage when moving said pushing unit outwardly of said housing and said second portion maintaining said fluid passage blocked for developing negative pressure in said stepped portion for drawing fluid cosmetics therein, said biasing means then further moving said second portion in the return direction for unblocking said fluid passage for drawing in fluid cosmetics from said reservoir, and said second portion contacting said shut-off unit for moving said shut-off unit out of said fluid passage for unblocking fluid communication between said brush and said reservoir.

2. A device as in claim 1 further comprising a substantially conical guide attached to said housing and substantially surrounded by said brush, said guide being in fluid communication with said fluid passage and said brush, said guide being tapered downwardly away from said housing and having at least two substantially equally spaced longitudinal notches extending substantially the length of said guide for leading fluid cosmetics from said fluid passage to said brush.

3. A device as in claim 1, wherein an idling gap is defined between said substantially L-shaped second portion of said pushing unit and said substantially L-shaped shut-off unit when said fluid passage is normally open.

4. A device as in claim 3, wherein the height of said idling gap is substantially equal to the height of said stepped portion of said fluid passage.

5. A fluid dispenser for fluid cosmetics comprising:

a housing having first and second ends;

a cosmetics reservoir in said housing for containing fluid cosmetics;

a brush attached to said first end of said housing for distributing fluid cosmetics; and a block unit attached to said housing between said brush and said reservoir for feeding fluid cosmetics from said reservoir to said brush, said block unit including a fluid passage fluidly communicating said brush and said reservoir, said fluid passage having first and second subparts, a pushing unit movably received in said block unit, said pushing unit having a first end extending outside said housing and a second end for extending into said fluid passage for blocking fluid communication between said brush and said reservoir at said first subpart of said fluid passage, a movable shut-off unit movably received in said block unit and adjacent to said second end of said pushing unit, said shut-off unit being movable into said fluid passage for shutting off fluid communication between said brush and said reservoir at said second subpart of said fluid passage, means on said second end of said pushing unit for moving said shut-off unit into said fluid passage after said second end of said pushing unit blocks off fluid communication at said first subpart of said fluid passage and for moving said shut-off unit out of said fluid passage after said second end of said pushing unit develops negative pressure between said first subpart and said second subpart of said fluid passage, said second end of said pushing unit first blocking communication between said brush and said reservoir at said first subpart of said fluid passage when said second end of said pushing unit is moved into said fluid passage, said second end of said pushing unit and said shut-off unit then both moving further into said fluid passage for both forcing fluid in said fluid passage blocked from said reservoir at said first subpart to said brush for distribution thereby when said second end of said pushing unit is pushed further into said fluid passage by said pushing unit and as said means for moving said shut-off unit concurrently moves said shut-off unit into said passage, said second end of said pushing unit and said shut-off unit still further moving into said fluid passage until said shut-off unit shuts off fluid communication between said brush and said reservoir at said second subpart of said fluid passage, said pushing unit then moving in the opposite return direction and moving said second end of said pushing unit partially out of said fluid passage while said first subpart of said fluid passage remains blocked by said second end of said pushing unit and said subpart of said fluid passage remains blocked for developing negative pressure between said first subpart and said second subpart of said fluid passage for drawing a fluid cosmetic from said reservoir into said fluid passage between said second subpart and said reservoir, said pushing unit then moving further in the opposite return direction for unblocking said fluid passage at said first subpart for drawing a fluid cosmetic into said fluid passage from said reservoir, and said means for moving said shut-off unit moving said shut-off unit in the opposite return direction for unblocking said second subpart of said fluid passage for fluidly communicating said brush and said reservoir.

* * * * *